US008266935B2

(12) United States Patent
Busch

(10) Patent No.: US 8,266,935 B2
(45) Date of Patent: Sep. 18, 2012

(54) LOCK MOUNTING SYSTEM

(75) Inventor: Craig Busch, Barrie (CA)

(73) Assignee: All Source Security Container Mfg. Corp., Barrie, Ontario (CA)

( * ) Notice: Subject to any disclaimer, the term of this patent is extended or adjusted under 35 U.S.C. 154(b) by 0 days.

(21) Appl. No.: 11/398,411

(22) Filed: Apr. 5, 2006

(65) Prior Publication Data

US 2007/0234767 A1 Oct. 11, 2007

(51) Int. Cl.
*E05B 9/08* (2006.01)

(52) U.S. Cl. ..... 70/370; 70/448; 70/451

(58) Field of Classification Search ..... 70/158–162, 70/370–371, 448–449, 451, 417, 452
See application file for complete search history.

(56) References Cited

U.S. PATENT DOCUMENTS

| | | | | | |
|---|---|---|---|---|---|
| 1,629,172 | A * | 5/1927 | Murphy | 70/370 |
| 3,899,907 | A * | 8/1975 | Prahl | 70/370 |
| 4,099,397 | A * | 7/1978 | Dauenbaugh | 70/371 |
| 4,338,806 | A * | 7/1982 | Cox | 70/417 |
| 4,381,656 | A * | 5/1983 | Hayakawa | 70/451 |
| 4,530,223 | A * | 7/1985 | Oliver | 70/417 |
| 4,688,409 | A * | 8/1987 | Oliver et al. | 70/417 |
| 4,712,403 | A * | 12/1987 | Markisello | 40/417 |
| 4,765,165 | A * | 8/1988 | O'Gara | 70/417 |
| 4,910,982 | A * | 3/1990 | Dana | 70/370 |
| 4,951,980 | A * | 8/1990 | Wetzel | 70/451 |
| 5,029,460 | A * | 7/1991 | Anastasiou | 70/452 |
| 5,056,344 | A * | 10/1991 | Bartczak | 70/381 |
| 5,606,883 | A * | 3/1997 | Svec | 70/370 |
| 5,657,652 | A * | 8/1997 | Martin | 70/85 |
| 6,079,241 | A * | 6/2000 | Burleigh et al. | 70/370 |
| 6,290,093 | B1 * | 9/2001 | Obriot et al. | 220/908 |
| 6,361,088 | B1 * | 3/2002 | Ramsauer | 292/202 |
| 6,412,317 | B1 * | 7/2002 | Martin | 70/370 |
| 6,581,422 | B1 * | 6/2003 | Chang | 70/159 |
| D490,686 | S * | 6/2004 | Martin | D8/343 |
| 6,748,778 | B1 * | 6/2004 | Higdon et al. | 70/370 |
| 6,895,789 | B2 * | 5/2005 | Masseth et al. | 70/159 |
| D520,860 | S * | 5/2006 | Martin | D8/343 |
| 2001/0045114 | A1 * | 11/2001 | Sokurenko | 70/370 |
| 2004/0069029 | A1 * | 4/2004 | Masseth et al. | 70/370 |
| 2004/0206759 | A1 * | 10/2004 | Busch | 220/908 |
| 2005/0193786 | A1 * | 9/2005 | Nakasone | 70/375 |
| 2005/0223765 | A1 * | 10/2005 | Masseth et al. | 70/370 |
| 2008/0156054 | A1 * | 7/2008 | Martin | 70/450 |

* cited by examiner

*Primary Examiner* — Christopher Boswell
(74) *Attorney, Agent, or Firm* — Fish & Richardson P.C.

(57) ABSTRACT

A lock mounting structure for mounting a lock to a part of a container is disclosed. The lock mounting structure comprises an outer part adapted to form an outer portion of the container part and an inner part adapted to form an inside portion of the container part and having a first surface for facing towards the inside of the container. The inner part includes a mounting structure for mounting the lock thereto. The mounting structure extends outwardly from the first surface. The structure also includes an aperture for accessing a key receiving end of the lock. The lock mounting structure is formed as an integral piece.

23 Claims, 10 Drawing Sheets

LOCK MOUNTING SYSTEM

FIELD OF THE INVENTION

This invention relates to a system for mounting a lock on a container and, in particular, but not limited to, a system for mounting a lock to a thin walled container.

BACKGROUND OF THE INVENTION

Moulded plastic containers are often used for storing recyclable materials such as paper. In many instances, it is preferable that the containers have lids which can be locked.

Plastic moulded containers normally have thin walls and lids. This fact presents challenges for mounting locks to such containers. In many cases, an external pad locks is used which extends through holes in the container. Such locking systems have the disadvantage of having a separate lock, which can easily be lost or misplaced, rather than having a lock permanently mounted on the container.

Locks, such as drawer locks and swivel locks, are intended to be mounted on thick walled containers. Drawer locks typically have a lock cylinder and a mounting structure at the end of the lock cylinder. The length of the lock cylinder typically closely matches the thickness of the container. To mount a drawer lock, the lock cylinder is inserted through a hole in the wall of the container and the mounting structure is screwed directly to the thick wall.

In cases where swivel locks have been mounted to thin walled containers, metal spacers and other extraneous pieces of hardware are required to adapt the lock to be mounted to the thin walled container. Such extraneous metal pieces must be riveted or screwed on, with the resulting danger of rusting, bending and breaking. Drawer locks have not previously been mounted to thin walled containers.

SUMMARY OF THE INVENTION

According to one aspect of the present invention, there is provided a lock mounting structure for mounting a lock to a part of a container, the lock comprising a key receiving end, the lock mounting structure comprising: an outer part adapted to form an outer portion of the container part; an inner part adapted to form an inside portion of the container part and having a first surface for facing towards the inside of the container; the inner part including a mounting structure for mounting the lock thereto, the mounting structure extending outwardly from the first surface; and an aperture for accessing the key receiving end; wherein the lock mounting structure is formed as an integral piece.

In some embodiments, the lock mounting structure is integrally formed with the container part.

In some embodiments, the part of the container is of molded construction and the lock mounting structure is integrally molded with the part of the container.

In some embodiments, the part comprises a closure for the container.

In some embodiments, the lock mounting structure is a discrete device adapted for attachment to the container.

In some embodiments, the lock further comprises a lock cylinder and the aperture is sized to encircle the lock cylinder.

In some embodiments, the aperture is surrounded by a reinforcing rim which extends at least one of (1) axially outward from an outer surface of the outer part and (2) axially inward from an inner surface of the inner part.

In some embodiments, the mounting structure comprises two or more discrete projections adapted for supporting the lock.

In some embodiments, the lock further comprises fastener receiving portions and one or more of the discrete projections are sized to mate with the fastener receiving portions.

In some embodiments, the fastener receiving portions comprise recesses and one or more of the discrete projections comprise ends sized and positioned to fit within the recesses.

In some embodiments, one or more of the projections each comprises a shoulder for supporting the lock.

In some embodiments, the container part comprises a closure for the container and wherein the lock includes a cam for engaging with a wall of the container, the wall of the container including a rim, the mounting structure extending a sufficient distance away from the surface to mount the lock at a position to allow the cam to cooperate with a cam aperture defined through the container below the container rim.

In some embodiments, the outer portion defines a well, the well having an upper surface which is below the outer surface of the container in use, the aperture being defined through the upper surface of the well, the key receiving end being thereby locatable below the outer surface of the container.

In some embodiments, the lock mounting structure further comprises a least one container mount protrusion for mounting the device to the container.

In some embodiments, a lock cover is adapted to mate with the at least one container mount protrusion and retain the device on the container.

According to another embodiment of the invention, there is provided a lock mounting apparatus for mounting a lock to a container wall, the lock comprising a key receiving end, the lock mounting apparatus comprising: a first part comprising: a flange for placement against an outer portion of the container wall; an inner part which is adapted to extend through the container wall to an inside surface of the container wall; the inner part including a mounting structure for mounting the lock thereto, the mounting structure adapted to extend inwardly of the container beyond the inside surface of the container wall; an aperture for enabling the key receiving end to be accessed from outside the container; and a second part adapted to fasten to the first part and clamp the container wall therebetween.

In some embodiments, the first part is formed as an integral piece.

In some embodiments, the second part comprises a cover for enclosing the inner part and the lock when in use, and an opening is defined through the cover for enabling a cam of the lock to pass therethrough.

In some embodiments, the first part defines one or more protrusions and the second part defines one or more respective cooperating receptacles for receiving a respective protrusion.

In some embodiments, at least one protrusion is adapted to receive a fastener to fasten the second part to the first part.

In some embodiments, a container and lock assembly incorporating the lock mounting structure described above comprises an opening and a container rim at least partially surrounding the opening and a closure for closing the opening, the lock mounting structure being disposed on the closure, and the lock including a cam for engaging with a wall of the container, the mounting structure being adapted to mount the lock at a position to allow the cam to cooperate with a cam aperture defined through the wall of the container below the container rim when the closure is closed.

In some embodiments, a cam recess is defined on an outer face of the cam and the cam recess is sized and positioned to receive a wall portion defining the cam aperture.

In some embodiments, the container rim includes a downwardly projecting portion and the cam aperture is located behind the downwardly projecting portion.

A further embodiment of the invention provides a container closure comprising a lock mounting structure for mounting a lock to the container closure, the lock comprising a key receiving end, the lock mounting structure comprising: an outer part adapted to form an outer portion of the container closure; an inner part adapted to form an inside portion of the container closure and having a first surface for facing towards the inside of the container; the inner part including a mounting structure for mounting the lock thereto, the mounting structure extending outwardly from the first surface; an aperture for accessing the key receiving end; and the container closure is adapted to mate and close an opening of the container; wherein the lock mounting structure is formed as an integral piece of the container closure.

BRIEF DESCRIPTION OF THE DRAWINGS

Embodiments of the invention will be further described, by way of example only, with reference to the accompanying drawings in which.

DETAILED DESCRIPTION OF THE PREFERRED EMBODIMENTS

Figure 1:
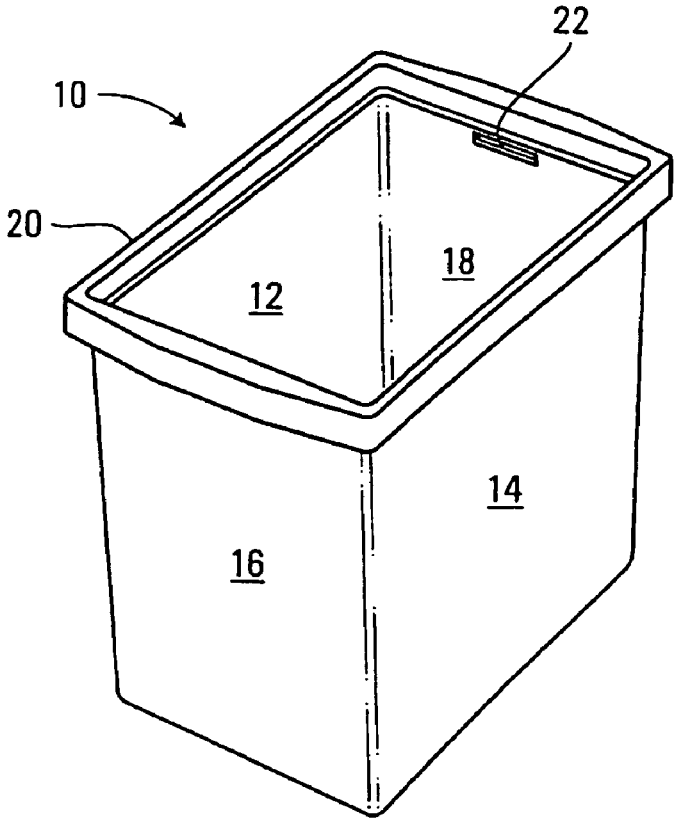
FIG. 1 is a rear perspective view of a container adapted for use with a lid utilizing the lock mounting system of an embodiment of the present invention.

FIGS. 3 to 5 and 9 to 20 show two embodiments of a lock mounting structure for mounting a lock to a part of a container according to the invention. The lock 60 (FIGS. 6 to 9) has a key receiving or outer end 65. The lock mounting structure generally includes an outer part adapted to form an outer portion of the part of the container. This includes a portion of a lid top surface 48 above webs 42 and 43 in FIGS. 3 to 5 and a flange 121 in FIGS. 11 to 16. The lock mounting structure also includes an inner part adapted to form an inside portion of the container and having a first surface for facing towards the inside of the container. This is defined by a portion of a lid bottom surface 50 including the webs 42 and 43 in FIGS. 3 to 5 and sides 123 and bottom 125 of the flanged portion 118 in FIGS. 11 to 16. The inner part including a mounting structure for mounting the lock 60, webs 42 and 43 and the post supports 130 in FIGS. 3 to 5 and 11 to 16 respectively. The mounting structure extending outwardly from the first surface as shown. Apertures for accessing outer end 65 are indicated as lock cylinder openings 36 and 124. The lock mounting structure is formed as a single integral piece.

Figure 2:
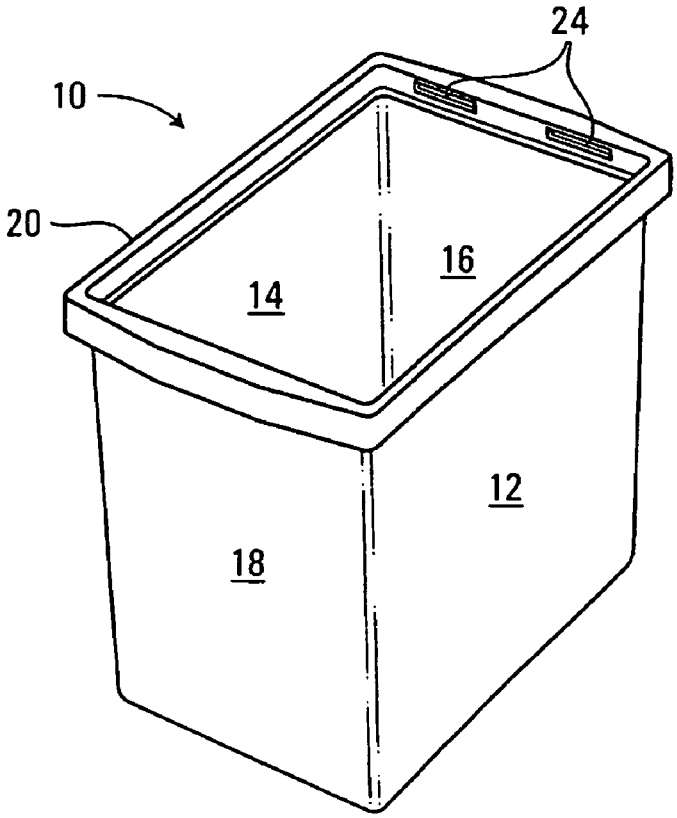
FIG. 2 is a front perspective view of the container of FIG. 1.

Turning to the figures in detail, FIGS. 1 and 2 show a personal document container (PDC) 10 without a lid 30. The PDC 10 has substantially upright sides 12 and 14 and a substantially upright front 18 and a substantially upright rear 16. The PDC 10 has an open top. A rim 20 encircles the open top of the PDC 10. Two elongated lid attachment openings 24 are defined through a vertical surface of the rim 20 at the rear 16 of the PDC 10. A horizontal elongated cam opening 22 is defined centrally through the front 18 of the PDC 10. The lid attachment and cam openings 22 and 24 are behind a downwardly projecting portion of the rim 20 of the PDC 10 such that they are not visible from the front or rear when the lid 30 is in place.

Figure 3:
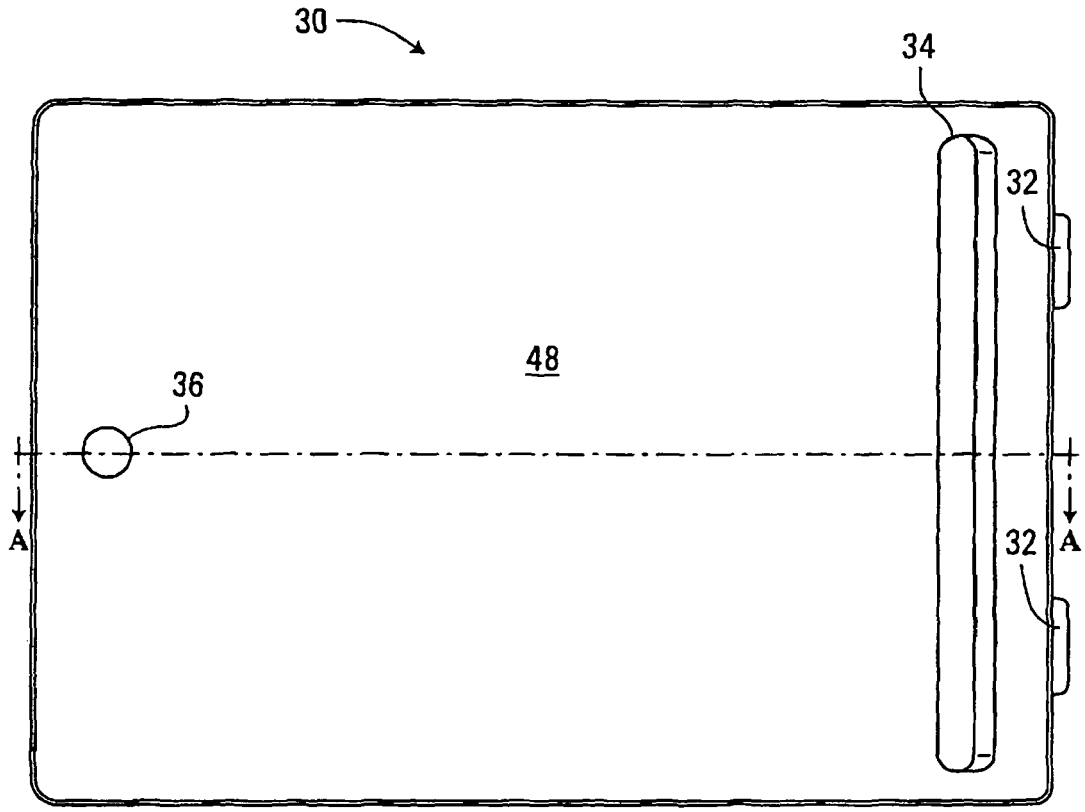
FIG. 3 is a top view of a lid for use with the container of FIG. 1.
Figure 4:
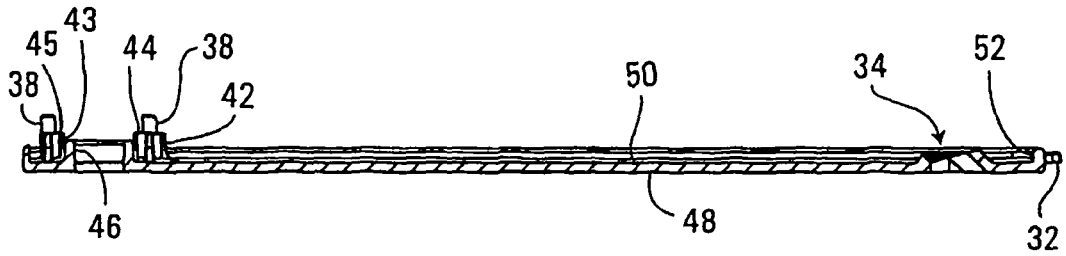
FIG. 4 is a sectional view of the lid of FIG. 3 taken along line AA showing a lock mounting system according to an embodiment of the present invention.
Figure 5:
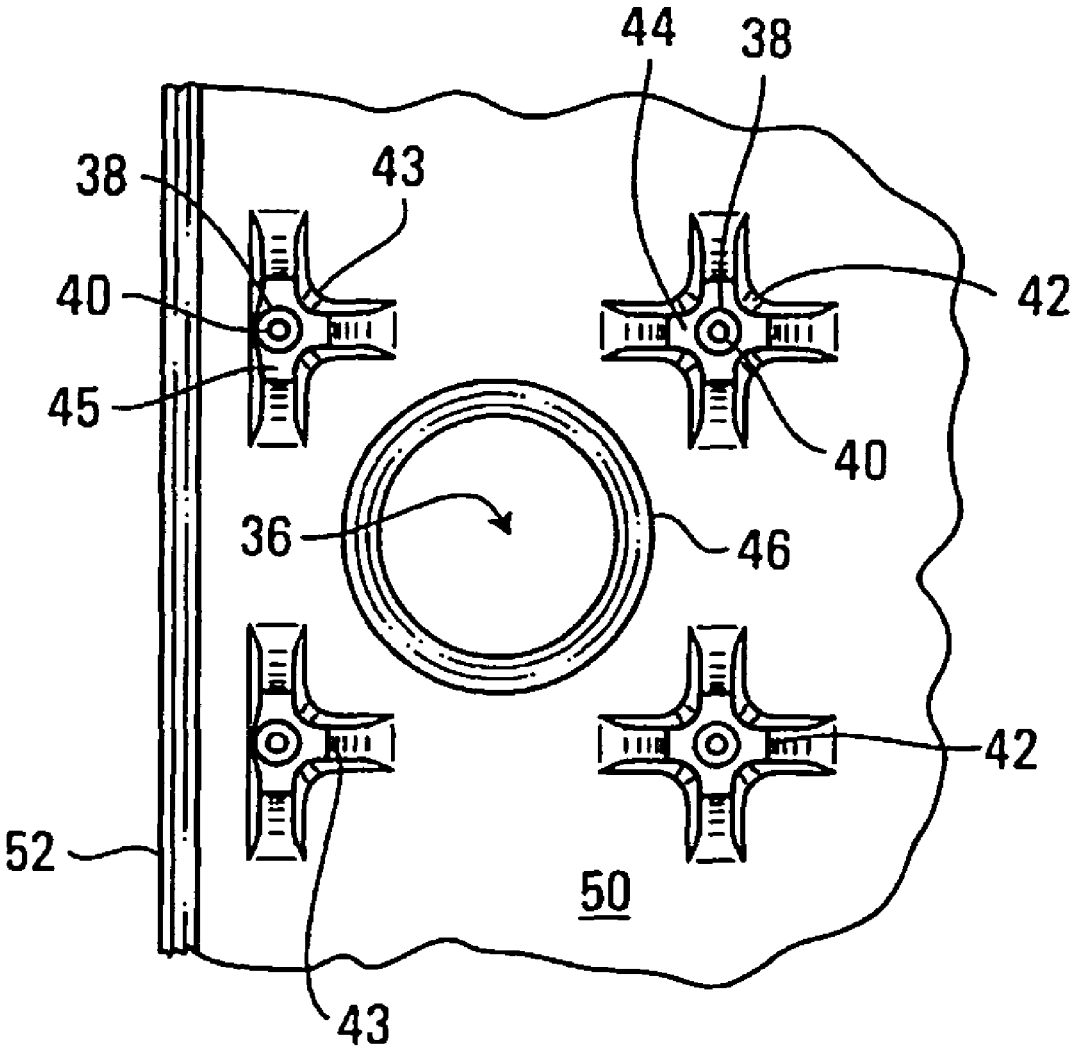
FIG. 5 is an enlarged bottom view of a portion of the lid of FIG. 3 showing the lock mounting system of FIG. 4.

In FIGS. 3, 4 and 5, the lid 30 is shown in detail. The lid 30 is a type of closure for a container and has the lid top surface 48 and the lid bottom surface 50. Two elongated lid attachment protrusions 32 extend laterally from a rear of the lid 30. A lip 52 is defined around the perimeter of the lid 30. The lid attachment protrusions 32 protrude from the lip 52. The lid attachment protrusions 32 are sized and positioned to insert into the lid attachment openings 24 of the PDC 10 to lock the rear 16 to the PDC 10.

An elongated opening 34 is defined through the lid 32 to allow material such as paper to be inserted into the PDC 10 when the PDC 10 is locked. An aperture or opening 36 is defined through the lid 30 adjacent the front of the lid 30 for receiving and encircling the circular lock cylinder of the lock 60.

The lock mounting structure is shown in FIGS. 4 and 5. The lock mounting structure comprises the two webs 42 and the two webs 43 (see FIG. 5). The webs 42 and 43 are protrusions that taper as they extend outwardly from the lid bottom surface 50. The webs 42 and the webs 43 are similar in shape but the web 43 is truncated on one side adjacent the lip 52. The webs 42 have a top surface 44 and the webs 43 have a top surface 45 which define supporting shoulders. In the embodiment shown, the top surfaces 44 and 45 are planer and all lie within the same plane. The webs 42 and 43 may be of solid plastic moulded or machined construction.

The posts 38, which comprise fastener receiving portions, protrude from the top surfaces 44 and 45 of the webs 42 and 43. The posts 38 may be cylindrical. A fastener hole 40 can be defined longitudinally through each of the posts 38. As with the webs 42 and 43, the end surface of each of the posts 38 can be planer and lies within the same plane.

The lock cylinder opening 36 which extends through the lid 30 is optionally centered within the four webs 42 and 43. The lock cylinder opening 36 is surrounded by a reinforcing ring or lock cylinder lip 46. In the embodiment, lock cylinder lip 46 protrudes axially inward from the inner or lid bottom surface 50 side of the lid 30. It could also protrude from the outer or lid upper surface 48 or from both.

Figure 6:
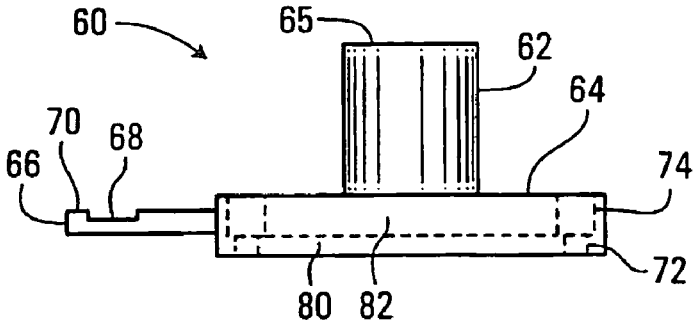
FIG. 6 is a side view of a lock for use with the lock mounting systems of FIGS. 3 to 5 with a cam extended.
Figure 7:
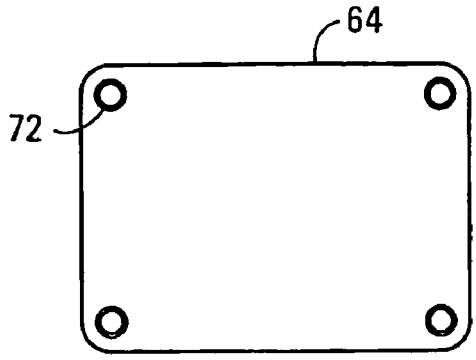
FIG. 7 is a bottom view of the lock of FIG. 6 with the cam retracted.
Figure 8:
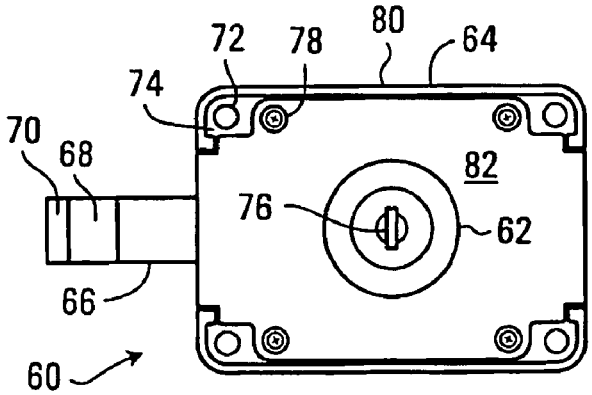
FIG. 8 is a top view of the lock of FIG. 6.

FIGS. 6 to 8 depict the lock 60 which may be utilized with the lock mounting structure of FIGS. 3 to 5. The lock 60 comprises the lock cylinder 62 and a mount assembly 64. The lock cylinder 62 has an outer end 65. A key hole 76 is provided through the outer end 65 such that a key can be inserted into a locking mechanism in the lock cylinder 62. The mount assembly 64 is located on the opposite end of the lock cylinder 62 from the outer end 65. The lock 60 is designed to be used with a thick walled container having a thickness substantially the same as the length of the cylinder 62.

The lock 60 also includes a cam 66. The cam 66 is shown extended in FIGS. 6 and 8 and retracted in FIGS. 7 and 9. The cam 66 is held within the mount assembly 64 in the retracted position and extends outwardly from the mount assembly 64 in the extended position. The cam 66 can be extended or retracted from the lock 60 by operation of a key inserted through the key hole 76 at the outer end 65 of the lock cylinder 62. The cam 60 has a cam recess 68 defined laterally across the cam 66. The cam recess 68 results in a cam protrusion 70 towards the end of the cam 66. The cam recess 68 and the cam protrusion 70 face the outer end 65 side of the lock 60.

The mounting assembly 64 includes a bottom lock plate 80 and a top lock plate 82. As best seen in FIG. 8, the bottom lock plate 80 and the top lock plate 82 are fastened together by lock connection screws 78. Four mounting holes 72 are defined at the corners of the bottom lock plate 80. Recesses 74 are defined around the mounting holes 72. The depth of the recesses 74 is equal to the thickness of the top lock plate 82 as best seen in FIG. 6.

Figure 9:
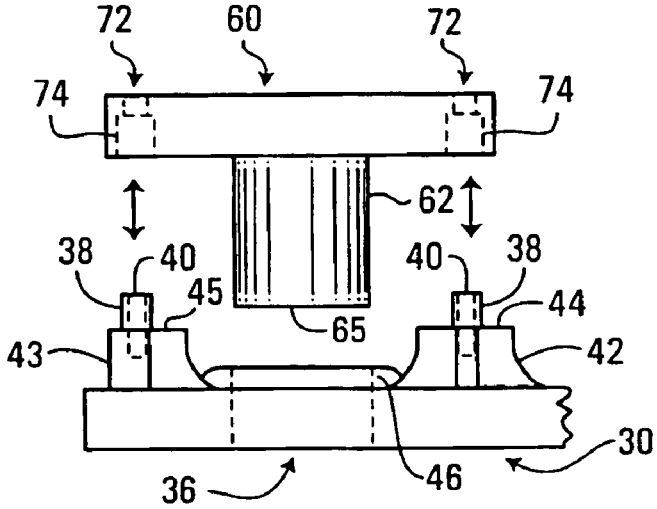
FIG. 9 is an assembly view showing the mounting of the lock of FIG. 6 on the lock mounting system of FIGS. 3 to 5.

FIG. 9 shows the mounting of the lock 60 on the lid 30. In particular, the outer end 65 of the cylinder 62 of the lock 60 is inserted through the lock cylinder opening 36 of the lid 30 from the inner side. At the same time, the posts 38 are inserted into the recesses 74 of the lock 60 until the top lock plate 82 comes to rest against the shoulders defined by web top surfaces 44 and 45. Screws or other fasteners are then inserted through the mounting holes 72 and screwed into screw holes 40 of the post 38 to hold the lock 60 securely to the lid 30. The outer end 65 may be flush with the lid top surface 48 or extend above or be recessed below. As can be seen in FIG. 9, the cylinder 62 is longer than the thickness of the lid 30 so that the outer end 65 is spaced from the mounting structure 64 a distance greater than the thickness of the lid 30. Rather than the discrete projections depicted, the webs 44 and 45 may be replaced by a combined piece.

The lid 30 can then be closed into the PDC 10 by inserting the lid attachment protrusions 32 into the lid attachment openings 24 once the lid 30 is positioned on top of the personal document container 10. The cam 66 can be actuated by a key inserted into the key hole 76 to move the cam 66 through the cam opening 22. The cam recess 68 is positioned such that it bridges the front wall 18 of the PDC 10. The cam protrusion 70 can then engage against the cam opening 22 if an attempt is made to open the lid 30 when locked. The cam recess 68 and resulting protrusion thereby helps to maintain the cam 66 engaged with the front 18 of the PDC 10.

The position, size and shape of the webs 42, 43 and post 38 assemblies can be selected, depending, for example, on the type of the lock 60 used. Other configurations and numbers of structures can be used with the present lock and other lock designs. In the present configuration, the posts 38 are sized to fit within the recesses 74. Also the dimension from the lid top surface 48 to the web top surfaces 44 and 45 can be chosen such that the outer end 65 of the lock cylinder 62 is flush with the lid top surface 48 when mounted. The lock cylinder lip 46 also helps to hold the lock 60 in position.

The mounting holes 72 for the lock 60 extend in the same direction as the lock cylinder 62. If the lock 60 were attempted to be mounted to the lid 30 without use of the mounting structure, then the lock cylinder 62 would extend significantly beyond the lid top surface 48 and screws inserted through the mounting holes 72 of a lock 60 and screwed through the lid 30 would protrude beyond the top surface of the lid 48. The thickness of the lid 30 alone would be insufficient to hold the lock 60 securely in position. The fasteners or screws used may have a length greater than that of the lid thickness but less than the thickness of the webs. The fasteners may alternatively have the same length, may have a length sufficient to extend part or all the way through the webs, but preferably insufficient in length to penetrate the outer surface of the lid.

Figure 10:
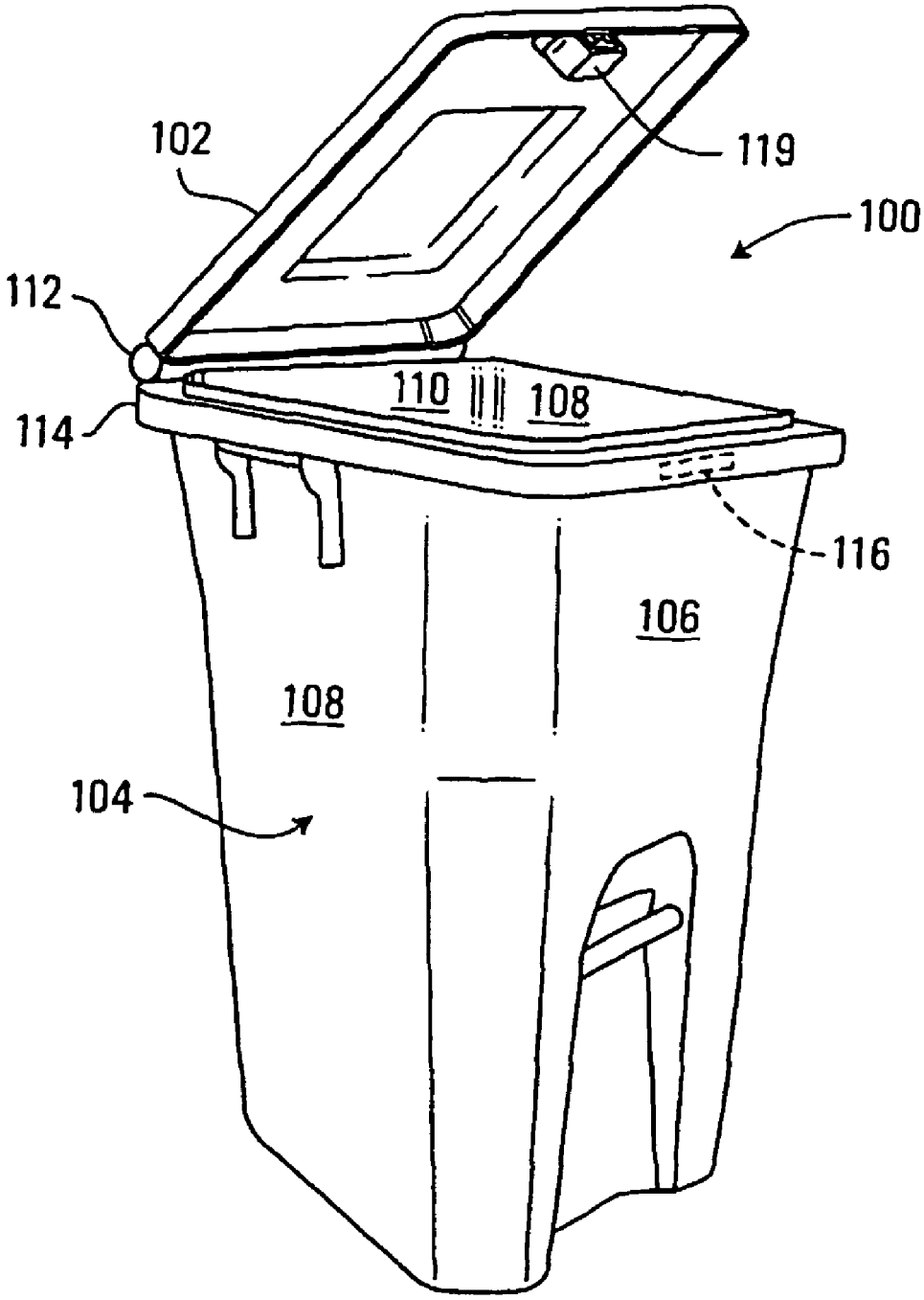
FIG. 10 is a front perspective view of a container for recyclable materials showing a lock mounting system according to a second embodiment of the invention.
Figure 11:
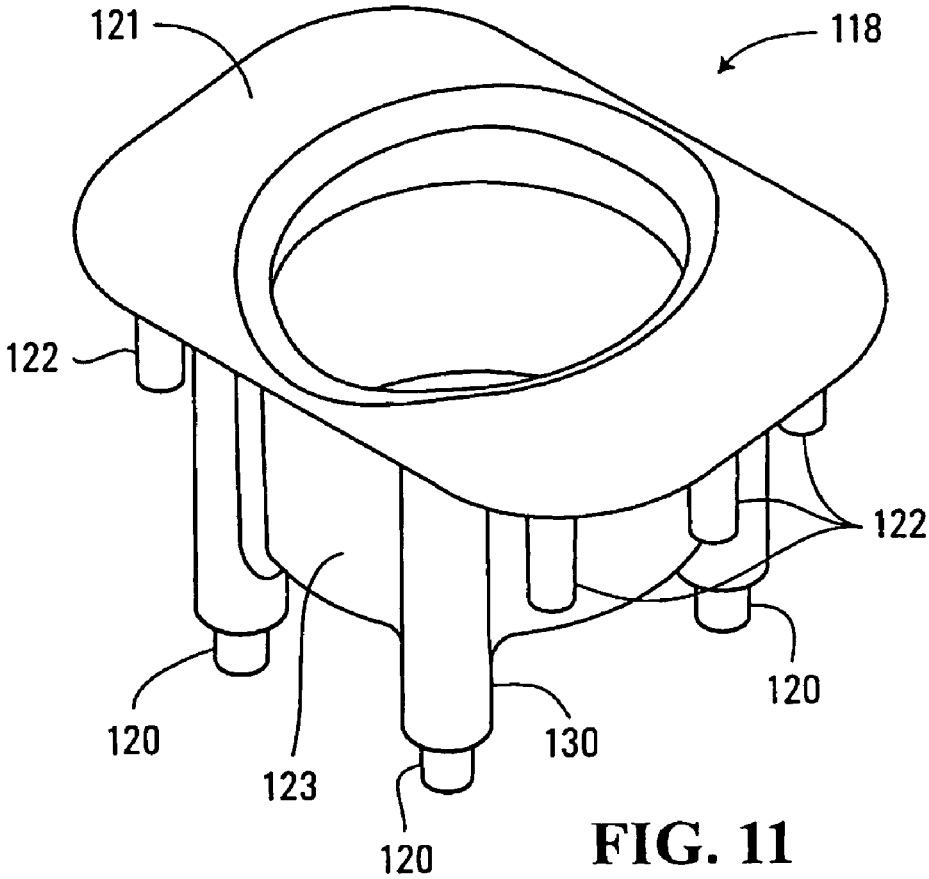
FIG. 11 is a perspective view of a flanged portion of the lock mounting system of FIG. 10.
Figure 12:
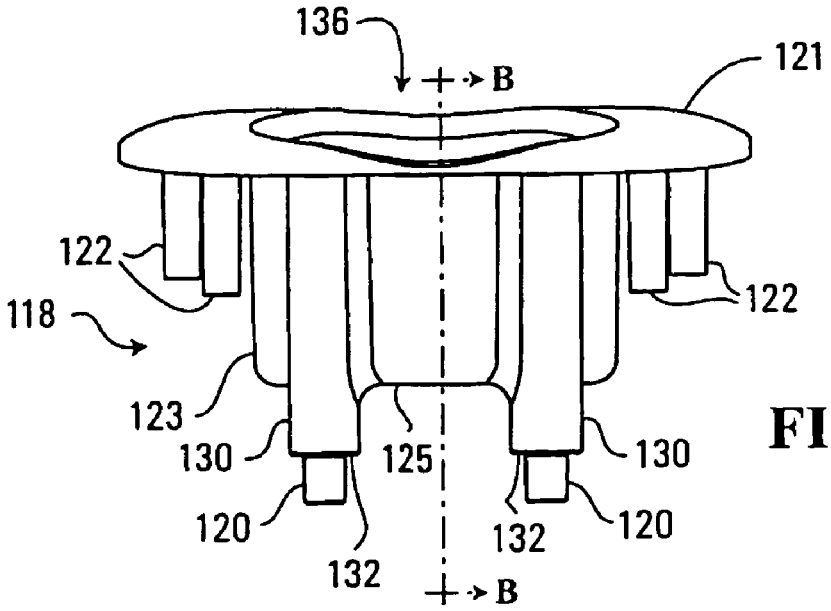
FIG. 12 is a front view of the flanged portion of FIG. 11.

FIG. 10 shows a cart 100 with a second embodiment of the lock mounting structure. The cart 100 has a cart lid 102 and a cart body 104. The cart body 104 has a front 106, opposed sides 108, a rear 110 and an open top. The cart body 104 has an open top and the cart sides, front, and rear 108, 106 and 110 respectively extend substantially downwardly from the top opening. A hinge 112 is provided at the rear of the cart 100 and rotatably connects the cart lid 102 to the cart rear 110. A lip 114 of the cart extends around the top opening of the cart 100. An elongate lateral opening or aperture 116 is defined through the cart front 106 behind a downwardly extending portion of the lip 114. Reinforcing webs (not shown) connect the lip 114 to the cart front, sides, and rear 106, 108 and 110 respectively. The opening 116 is positioned below the reinforcing webs.

A lock mounting assembly 119 is mounted on the front of the cart lid 102. The components of the lock mounting assembly 119 are shown in detail in FIGS. 11 to 21. The lock mounting assembly 119 is comprised of a flanged portion or device 118, a cover 140, and a lock such as the lock 60, and various fasteners.

Figure 13:
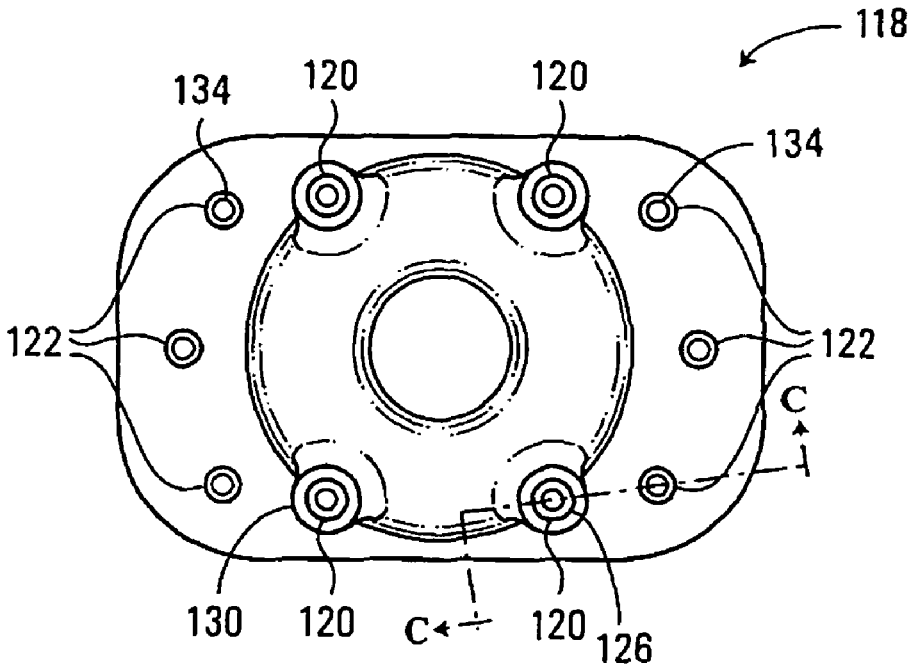
FIG. 13 is a bottom view of the flanged portion of FIG. 11.
Figure 14:
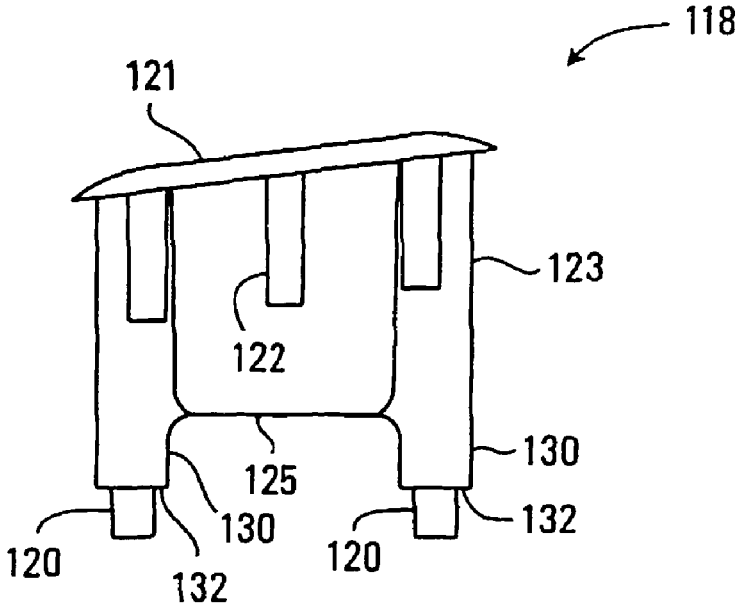
FIG. 14 is a side view of the flanged portion of FIG. 11.
Figure 15:
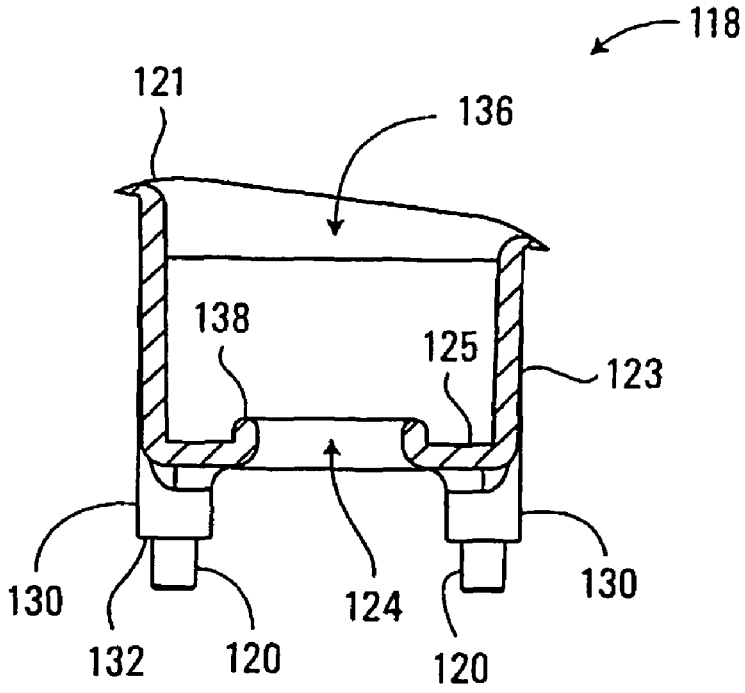
FIG. 15 is a cross-sectional view of the flanged portion of FIG. 11 taken along line BB of FIG. 12.
Figure 16:
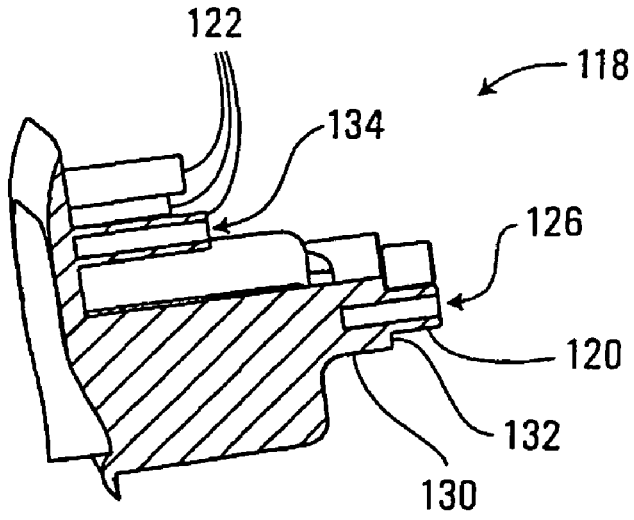
FIG. 16 is a cross-sectional view of the flanged portion of FIG. 11 taken along line CC of FIG. 13.

Turning to FIGS. 11 to 16, the flanged portion 118 has a top 121, sides 123, and a bottom 125 as best seen in FIG. 15. The top 121 defines a top opening 136. The top 121 has a laterally extending flange for positioning against the lid 102. The bottom surface of the top 121 may be flat and angled slightly from front to rear (see FIG. 14). Six protrusions 122 extends downward from the bottom surface of the top 121 in a direction substantially parallel to the lock cylinder 62, when mounted in the receptacle. The six protrusions 122 are positioned around the top 121 as best seen in FIG. 13. Screw holes 13 are provided in the protrusions 122 as best seen in FIG. 16.

A lock cylinder opening 124 is defined through the bottom 125. A lock cylinder lip 138 surrounds the lock cylinder opening 124 and protrudes within the flanged portion 118 as best seen in FIG. 15. The sides 123 of the flanged portion 118 extend substantially perpendicular to the bottom 125 thereby defining a well. Four post supports 130 extend along the sides 123 of the flanged portion 118 and protrude outwardly beyond the bottom 125. The post supports 130 have end surfaces 132, which are substantially planer and all lie within the same plane. Posts 120 protrude from the post support end surfaces 132. Screw holes or other means adapted to receive fasteners 126 are formed in each of the posts 120 and may extend through a portion of the post support 130 as best seen in FIG. 16.

FIGS. 17 to 20 depict the cover 140. A body 148 of the cover 140 is shaped to receive the flanged portion 118. Six protrusion receptacles 144 are defined in the cover 140 and sized to receive the protrusions 122 of the flanged portion 118.

Figure 19:
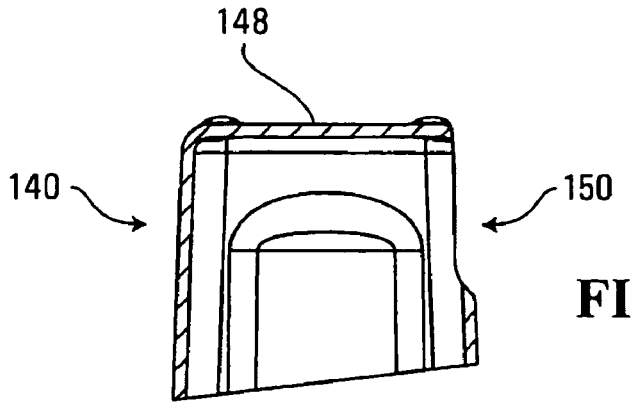
FIG. 19 is sectional view of the bottom cover taken along line DD of FIG. 18.
Figure 20:
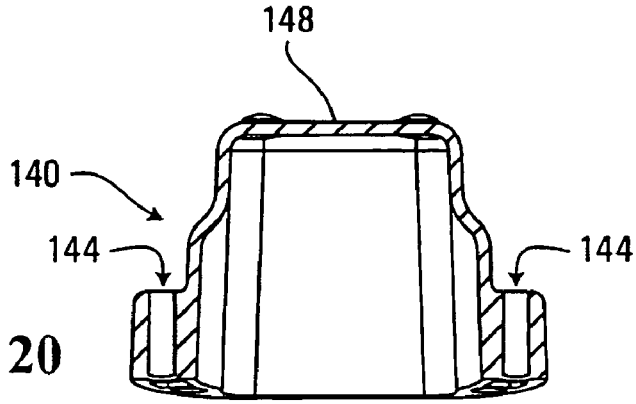
FIG. 20 is a cross-sectional view of the bottom cover of FIG. 17 taken along line EE of FIG. 18.

A lock cam opening 150 is defined through the front of the cover 140 (see FIG. 19).

Figure 21:
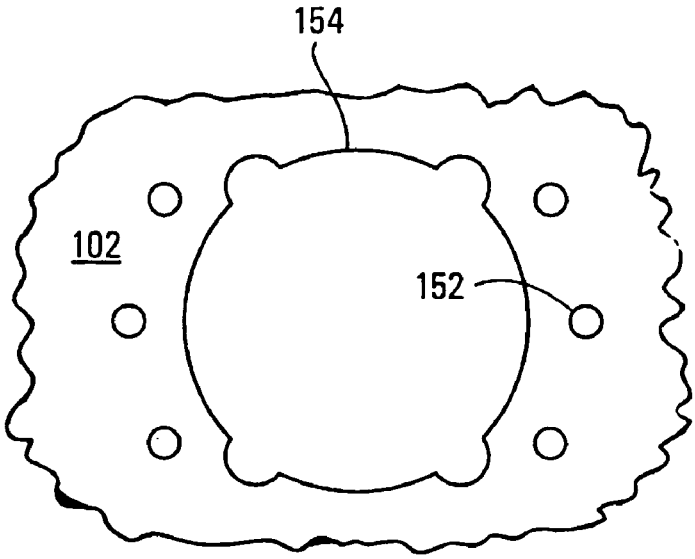
FIG. 21 is a partial top view of the container cover of FIG. 10 showing the holes for receiving the flanged portion of FIGS. 11 to 16.

FIG. 21 shows an enlarged portion of the lid 102 of the cart 100. The lid 102 has six lid protrusion holes 152 which are sized and positioned to receive the protrusions 122 of the flanged portion 118. A hole 154 is also provided through the lid 102 to receive the body of the flanged portion 118 with the flange resting against the outer surface of lid 102.

In use a lock, such as lock 60 of FIGS. 6 to 9 can be mounted to the flanged portion 118 in a similar manner as the lock 60 is shown in FIG. 9 to be mounted to the lid 30. In particular, each post 120 is inserted into the recesses 74 of the lock 60, until the lock top plate 82 abuts against the post support end surfaces 132. Screws are inserted through the screw holes 72 of the lock 60 and screwed through the screw holes 126 of the posts 120 and post supports 130 to secure the lock 60 to the flanged portion 118.

The body of the flanged portion 118 is then inserted from the top surface of the lid into the lid opening 154 from an outer side of the cart 100. The protrusions 122 extend through the lid protrusion holes 152 and the body of the flanged portion 118 extends inwardly through the lid and below the bottom surface thereof. The flanged portion 118 then extends through the lid 102 to the inside surface of the cart. The bottom surface of the top 121 of the flanged portion 118 is positioned against the top surface of the lid 102. The angle of the bottom surface of the top 121 corresponds to the angle of the lid 102 such that the sides 123 of the flanged portion 118 extend vertically and the bottom 125 of the flanged portion 118 extends horizontally when the lid 102 is in a closed position.

Figure 17:
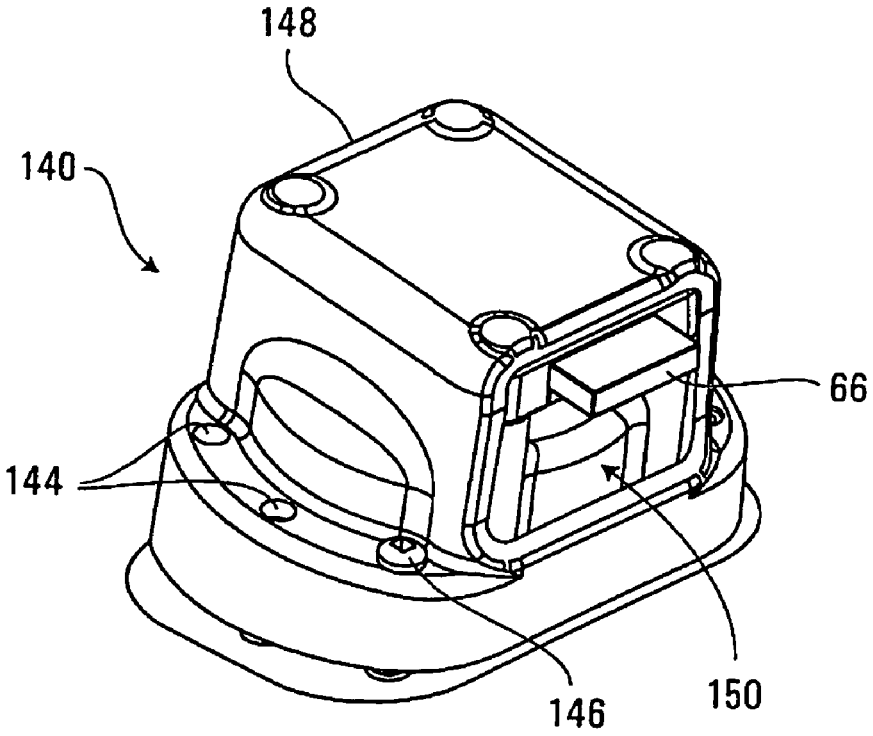
FIG. 17 is a bottom perspective view of the embodiment of FIG. 10 showing the lock and the lock mounting system but not the lid of the container.
Figure 18:
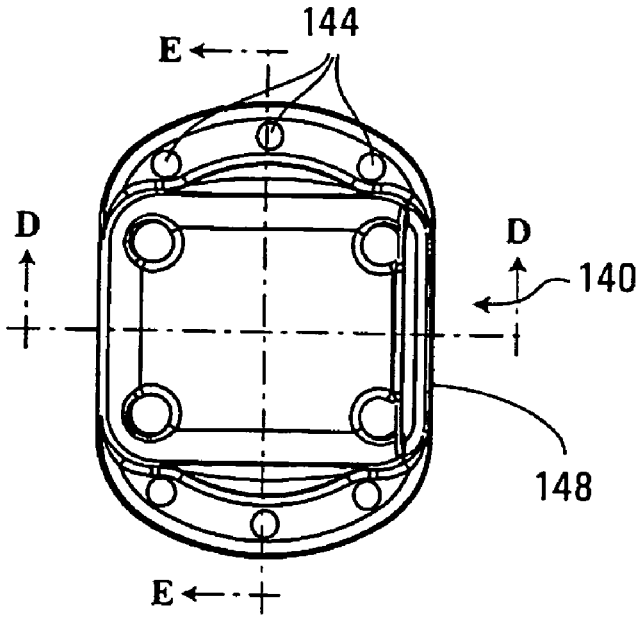
FIG. 18 is the bottom view of the bottom cover.

The cover 140 is then positioned over the flanged portion 118, from the lower surface of the lid as seen in FIG. 17. The protrusions 122, after extending through the protrusion holes 152 of the lid 102, then extend into the protrusion receiving holes 144 of the cover 140. The protrusions 122 are sized to snugly fit into the receiving holes 144 and are shorter than the receiving holes 144. Screws 146 are then inserted through the open end of the protrusion receiving holes 144 and screwed into the protrusions 122 to connect the cover to the flanged portion with the lid sandwiched and clamped between the two.

As can be seen in FIG. 7 the lock 60 is oriented so that the lock cam 60 extends through the lock cam opening 150 when actuated when the lid is closed. The actuation of the lock 60 causes the lock cam 66 to protrude through the cart lock cam opening 116 to lock the lid 102 in place.

When assembled, the outer end 65 of the lock cylinder 160 is flush with the top of the lock cylinder lip 138. The flanged portion 118, including the well and post supports 130, provides a support structure for supporting a lock which allows the outer end 65 and the cam of the lock to be located at a level below the outer surface and within the body of the cart which corresponds to the desired level of the cam opening in the front 106 of the cart 100. For example, the arrangement allows the cart lock cam opening 116 to be positioned a sufficient distance below the reinforcing web of the cart body lip 114. The length of the cylinder 62 of the lock 60 would not allow the cam 66 to extend through the cart lock cam opening 116 if the top of the cylinder 62 was mounted flush with the top of the cart 102. It will be understood that if a cylinder of greater length were utilized, the sides 123 and post supports 130 of the flanged portion 118 could be substantially shortened or eliminated. In this embodiment, nothing is directly screwed into or fastened to the lid.

The lock mounting structure of the present invention may be machine or moulded from plastic or other suitable material. The structure may be integrally formed with the lid or molded as a discrete device.

Although a particular lock 60 is shown in the examples provided herein, other lock design, such as swivel locks, may be utilized with this invention. The other lock designs could necessitate other shape and numbers of supports and other attachments means or fasteners other than screws. The same type of lock can be used for both thin walled and thick walled containers, such as a wooden console, so that one key may be used with both.

Although the separate lock mounting device is shown as having protrusions which connect the flanged portion 118 to the lid 102 and the cover 140, it will be understood that other attachments means could be utilized and it will also be understood that the cover could be eliminated in its entirety and the flanged portion 118 directly secured to the lid 102. The body of the flanged portion 118 can also be integrally produced with the lid 102 rather than provided as a separate device.

The lock cylinder lips 138 and 46 help to support the lock cylinder but are not essential. The posts 120, 38 may also be eliminated and the lock screw directly into the underlying support.

The design of the separate lock mounting device may also be altered to provide the lock at other angles other than strictly vertical.

The lock mounting structure may also be mounted to a vertical wall of the container and the cam opening accordingly defined in the lid. It will be understood that "wall" when used herein is intended to include a closure or lid.

Numerous modifications and variations of the present invention are possible in light of the above teachings. It is therefore to be understood that within the scope of the appended claims, the invention may be practiced otherwise than as specifically described herein.

I claim:

1. A lock mounting structure for mounting a lock to a container closure, the lock comprising a key receiving end and a mounting assembly end, the lock mounting structure comprising:

an outer part adapted to form a portion of an outside of the container closure;

an inner part adapted to form a portion of an inside of the container closure and having an inside surface for facing towards the inside of the container;

the inner part including at least one projection for extending towards the inside of the container from the inside surface, the at least one projection comprising support surfaces for facing the inside of the container and posts for extending towards the inside of the container from the support surfaces, the support surfaces being wider than the posts to define shoulders spaced from the inside surface, the posts each comprising an end surface for facing towards the inside of the container for mounting the lock mounting assembly end to the at least one projection with the mounting assembly end directly abutting the shoulders of the at least one projection; and an aperture for accessing the key receiving end;

wherein the lock mounting structure is a single molded or machined part.

2. The lock mounting structure according to claim 1 wherein the lock mounting structure is integrally formed with the container closure.

3. The lock mounting structure according to claim 2 wherein the container closure is of molded construction and the lock mounting structure is integrally molded with the container closure.

4. The lock mounting structure according to claim 1 wherein the lock mounting structure is a discrete device adapted for attachment to the container.

5. The lock mounting structure according to claim 4 wherein the lock mounting structure further comprises at least one container mount protrusion for mounting the device to the container.

6. The lock mounting structure according to claim 5 further comprising a lock cover adapted to mate with the at least one container mount protrusion and retain the device on the container.

7. The lock mounting structure according to claim 1 wherein the lock further comprises a lock cylinder and the aperture is sized to encircle the lock cylinder.

8. The lock mounting structure according to claim 7 wherein the aperture is surrounded by a reinforcing rim which extends at least one of (1) axially outward from an outer surface of the outer part and (2) axially inward from an inner surface of the inner part.

9. The lock mounting structure according to claim 1 wherein the at least one projection comprises two or more discrete projections adapted for supporting the lock, and wherein each of the two or more discrete projections comprises one of the support surfaces and one of the posts.

10. The lock mounting structure according to claim 9 wherein the lock further comprises fastener receiving portions and the posts are sized to mate with the fastener receiving portions.

11. The lock mounting structure according to claim 10 wherein the fastener receiving portions comprise recesses and the posts are sized and positioned to fit within the recesses.

12. The lock mounting structure according to claim 11 wherein the support surfaces each comprise a shoulder for supporting the lock.

13. The lock mounting structure of claim 1 wherein the lock includes a cam for engaging with a wall of the container, the wall of the container including a rim, the at least one projection extending a sufficient distance away from an outer surface of the container closure adjacent to the outer portion of the container closure formed by the outer part to mount the lock at a position to allow the cam to cooperate with a cam aperture defined through the container below the container rim.

14. The lock mounting structure of claim 13 wherein the outer part defines a well, the well having an upper surface which is below the outer surface of the container closure in use, the aperture being defined through the upper surface of the well, the key receiving end being thereby locatable below the outer surface of the container closure.

15. A container and lock assembly incorporating the lock mounting structure of claim 1 wherein the container comprises an opening and a container rim at least partially surrounding the opening and a closure for closing the opening, the lock mounting structure being disposed on the closure, and the lock including a cam for engaging with a wall of the container, the mounting structure being adapted to mount the lock at a position to allow the cam to cooperate with a cam aperture defined through the wall of the container below the container rim when the closure is closed.

16. The container and lock assembly of claim 15 wherein a cam recess is defined on an outer face of the cam and the cam recess is sized and positioned to receive a wall portion defining the cam aperture.

17. The container and lock assembly of claim 16 wherein the container rim includes a downwardly projecting portion and the cam aperture is located behind the downwardly projecting portion.

18. A lock mounting apparatus for mounting a lock to a container closure, the lock comprising a key receiving end and a lock mounting assembly end, the lock mounting apparatus comprising:

a first part comprising:

a flange for placement against an outer portion of the container closure;

an inner part which is adapted to extend through the container closure to an inside surface of the container closure;

the inner part including at least one projection for extending towards the inside of the container from the inside surface, the at least one projection comprising support surfaces for facing the inside of the container and posts for extending towards the inside of the container from the support surfaces, the support surfaces being wider than the posts to define shoulders spaced from the inside surface, the posts each comprising an end surface for facing the inside of the container for mounting the lock mounting assembly end to the at least one projection with the lock mounting assembly end directly abutting the shoulders of the at least one projection;

an aperture for enabling the key receiving end to be accessed from outside the container; and an opening spaced from the aperture for receiving the lock; and a second part adapted to fasten to the first part and clamp the container closure therebetween;

wherein the first part is formed as a single molded or machined part.

19. The lock mounting apparatus according to claim 18 wherein the first part is formed as an integral piece.

20. The lock mounting apparatus according to claim 18 wherein the second part comprises a cover for enclosing the inner part and the lock when in use, and an opening is defined through the cover for enabling a cam of the lock to pass therethrough.

21. The lock mounting apparatus according to claim 18 wherein the first part defines one or more protrusions and the second part defines one or more respective cooperating receptacles for receiving a respective protrusion.

22. The lock mounting apparatus according to claim 21 wherein at least one protrusion is adapted to receive a fastener to fasten the second part to the first part.

23. A container closure comprising a lock mounting structure for mounting a lock to the container closure, the lock comprising a key receiving end and a mounting assembly end, the lock mounting structure comprising:

an outer part forming a portion of the outside of the container closure;

an inner part forming a portion of the inside of the container closure and having an inside surface for facing towards the inside of the container;

the inner part including at least one projection for extending towards the inside of the container from the inside surface, the at least one projection comprising a support surface for facing the inside of the container and posts for extending towards the inside of the container from the support surface, the support surfaces being wider than the posts to define shoulders spaced from the inside surface, the posts each comprising an end surface for facing towards the inside of the container for mounting the leek mounting assembly end to the at least one projection with the lock mounting assembly end directly abutting the shoulder of the at least one projection; and an aperture for accessing the key receiving end; and the container closure is adapted to mate with and close an opening of the container;

wherein the lock mounting structure is formed as a single molded or machined part.

* * * * *

UNITED STATES PATENT AND TRADEMARK OFFICE

CERTIFICATE OF CORRECTION

PATENT NO. : 8,266,935 B2
APPLICATION NO. : 11/398411
DATED : September 18, 2012
INVENTOR(S) : Craig Busch It is certified that error appears in the above-identified patent and that said Letters Patent is hereby corrected as shown below:

In the Claims:

Column 11, line 6, Claim 23, please delete "leek".

Signed and Sealed this
Fourth Day of December, 2012

David J. Kappos

David J. Kappos
*Director of the United States Patent and Trademark Office*